US005838341A

United States Patent [19]

Hiwada

[11] Patent Number: 5,838,341

[45] Date of Patent: Nov. 17, 1998

[54] CONTROLLER FOR AN ACTUATOR DRIVING CIRCUIT WITH ABNORMAL TEMPERATURE MONITORING CAPABILITY

[75] Inventor: Shuhei Hiwada, Toyoake, Japan

[73] Assignee: Brother Kogyo Kabushiki Kaisha, Nagoya, Japan

[21] Appl. No.: 615,882

[22] Filed: Mar. 14, 1996

[30] Foreign Application Priority Data

Mar. 15, 1995 [JP] Japan ..... 7-055504

[51] Int. Cl.[6] ..... B41J 29/38; H05B 1/00; H05B 1/02

[52] U.S. Cl. ..... 347/14; 347/17; 219/216; 219/501

[58] Field of Search ..... 347/14, 17, 188, 347/194, 211; 219/216, 483, 486, 501; 236/44

[56] References Cited

U.S. PATENT DOCUMENTS 4,322,733 3/1982 Moriguchi et al. ..... 346/74 PH 5,132,709 7/1992 West ..... 346/76 PH

*Primary Examiner*—Peter S. Wong
*Assistant Examiner*—Rajnikant B. Patel
*Attorney, Agent, or Firm*—Oliff & Berridge, PLC

[57] ABSTRACT

To prevent a driving circuit from being thermally destroyed, each of a plurality of driving units has a temperature sensor which is a diode train consisting of a plurality of junction diodes connected in series. An output line is connected to temperature sensor to output a temperature signal indicative of the temperature of the corresponding driver. Such output lines derived from the plurality of driving units are commonly connected to form a common connection point. The common connection point outputs a combined temperature signal indicative of the temperature in drivers of the plurality of driving units. A controller is connected to the common connection point to receive the combined temperature signal, and determines whether or not at least one of the plurality of driving units is in a temperature abnormality condition based on the combined temperature signal.

14 Claims, 7 Drawing Sheets

CONTROLLER FOR AN ACTUATOR DRIVING CIRCUIT WITH ABNORMAL TEMPERATURE MONITORING CAPABILITY

BACKGROUND OF THE INVENTION

1. Field of the Invention

The present invention relates to a controller for a driving circuit for driving actuators, such as heads of an ink jet printer.

2. Description of the Related Art

A conventional driving circuit for driving actuators is shown in FIG. 1. The driving circuit includes a plurality of driving units 60A, 60B, 60C and 60D. Each driving unit includes a driver 61A, 61B, 61C, 61D for driving an actuator connected to the driver, and a temperature sensor 61A, 61B, 62C, 62D for sensing the temperature of the associated driver. A controller 66 is connected to the driver units 60A, 60B, 60C and 60D and outputs instruction signals thereto. The outputs of temperature sensors 62A, 62B, 62C, 62D are applied through respective temperature signal lines 64A, 64B, 64C, 64D to a change-over circuit 65. In response to a control signal from controller 66, change-over circuit 65 selects one of the temperature signal lines 64A, 64B, 64C, 64D. A temperature signal on the selected temperature signal line is connected to a level converter 67 which in turn outputs the temperature signal to controller 66 upon converting the temperature signal to a signal adapted for controller 66.

When controller 66 outputs instruction signals to driving units to drive actuators, power loss in any of the drivers in driving units is dissipated as heat. Controller 66 outputs the control signal to change-over circuit 65 at every predetermined time interval or at a constant time interval falling within a period of time during the actuators being driven in order to switch the temperature signal line to be connected to level converter 67. Controller 66 receives the temperature signal transmitted through the selected temperature signal line via level converter 67 and monitors temperature in driving units 60A, 60B, 60C and 60D. If controller 66 determines that temperature in any one of driving units 60A, 60B, 60C and 60D is excessively increased, then controller 66 outputs instruction signals to driving units 60A, 60B, 60C and 60D causing to drive the actuators in a slow mode, intermittent mode or controller 66 outputs stop signals to driving units to stop driving the actuators. As a result, the power loss is reduced to an allowable rate or to substantially zero, and so thermal destruction of driving units 60A, 60B, 60C and 60D can be prevented.

FIG. 2 shows another conventional driving circuit. Change-over circuit provided in the circuit of FIG. 1 is removed in the circuit of FIG. 1. Instead, four level converters 70A, 70B, 70C and 70D are provided to respective ones of driving units 60A, 60B, 60C and 60D individually. In the circuit configuration of FIG. 2, controller 71 receives temperature signals in succession from level converters 70A, 70B, 70C and 70D and determines whether or not the driving unit has become excessively high temperature.

However, the above-described conventional driving circuits are involved with the following problems. In the circuit of FIG. 1, because the temperature signals are outputted from driving units 60A, 60B, 60C and 60D, a change-over circuit is required which is provided with input terminals corresponding in number to driving units 60A, 60B, 60C and 60D. As the number of driving units increases, the monitoring frequency for the increased number of driving units becomes high. That is, the monitoring interval for monitoring each driving unit by the controller is prolonged as the number of driving units increases. Therefore, the thermal destruction of driving units 60A, 60B, 60C and 60D cannot be reliably prevented with the driving circuit shown in FIG. 1. Further, the provision of change-over circuit 65 increases cost of the circuit.

The driving circuit shown in FIG. 2 requires a plurality of level converters 70A, 70B, 70C and 70 corresponding in number to driving units 60A, 60B, 60C and 60D. Therefore, the circuit of FIG. 2 has the same disadvantage as is the circuit of FIG. 1. That is, the more does the number of driving units increase, the longer is the monitoring interval for monitoring each driving unit. The thermal destruction of driving units 60A, 60B, 60C and 60D cannot be reliably prevented with the driving circuit shown in FIG. 2.

SUMMARY OF THE INVENTION

In view of the foregoing, the present invention has been made to solve the aforementioned problems accompanying the conventional actuator driving circuits, and accordingly an object of the present invention is to provide an actuator driving circuit with an improved abnormal temperature monitoring capability wherein the temperature monitoring of each driving unit is accurately and quickly performed so that the driving unit may not be thermally damaged even if the driving unit dissipate heat.

To achieve the above and other objects, there is provided a driving circuit which includes a plurality of driving units and a controller connected thereto. Each driving unit includes a driver for driving an actuator, a temperature sensor for sensing a temperature of the driver, and an output line connected to the temperature sensor and outputting a temperature signal indicative of the temperature of the driver. The output lines derived from the plurality of driving units are commonly connected to form a common connection point. The common connection point outputs a combined temperature signal indicative of the temperature in drivers of the plurality of driving units. That is, when there is a thermal malfunction in at least one of the driving units, the combined temperature signal indicates such a condition. The controller has an input connected to the common connection point to receive the combined temperature signal and determines whether or not at least one of the plurality of driving units is in a temperature abnormality condition based on the combined temperature signal.

In an example shown in FIG. 3, the temperature sensor (5A, 5B, 5C, SD) includes a first current supplying source (VA, 4A; VB, 4B; VC, 4C; VD, 4D), at least one junction diode (3A, 3B, 3C, 3D) having a cathode end connected to ground and an anode end connected to the first current supplying means (VA, 4A; VB, 4B; VC,4C; VD, 4D), and a rectifying diode (5A, 5B, 5C, 5D) having an anode connected to the common connection point and a cathode connected to a juncture point between the first current supplying source (VA, 4A; VB, 4B; VC,4C; VD, 4D) and the anode end of the at least one junction diode (3A, 3B, 3C, 3D). A second current supplying source (V2, 8) is further connected to the common connection point. The second current supplying source includes a voltage source (V2) and a resistor (8) having one end connected to the voltage source (V2) and another end connected to the common connection point. In such a circuit arrangement, the change of the temperature in any of the driving units appears as a change in voltage developed across the resistor (8).

In another example shown in FIG. 5, the temperature sensor includes a first current supplying source (VA, VB, VC, VD), at least one junction diode (3A, 3B, 3C, 3D) having a cathode end connected to ground and an anode end connected to the first current supplying source (VA, VB, VC, VD), a second current supplying source (VA, VB, VC, VD), and a rectifying diode (5A, 5B, 5C, 5D) having an anode connected to both the second current supplying source (VA, VB, VC, VD) and the common connection point and a cathode connected to a junction point between the first current supplying source (VA, VB, VC, VD) and the anode end of the at least one junction diode (3A, 3B, 3C, 3D).

In still another example shown in FIG. 6, the temperature sensor includes a first voltage source (VA, VB, VC, VD), at least one junction diode (21A, 21B, 21C, 21D) having an anode end connected to the first voltage source (VA, VB, VC, VD) and a cathode end, a first resistor (22A, 22B, 22C, 22D) having one end connected to the cathode end of the at least one junction diode (21A, 21B, 21C, 21D) and another end connected to ground, and a rectifying diode (23A, 23B, 23C, 23D) having an anode connected to a junction point between the cathode end of the at least one junction diode (21A, 21B, 21C, 21D) and the one end of the first resistor (22A, 22B, 22C, 22D) and a cathode connected to the common connection point. A second resistor (26) is further provided which has one end connected to ground and another end connected to the common connection point.

In further example shown in FIG. 6, the temperature sensor includes a first voltage source (VA, VB, VC, VD), at least one junction diode (21A, 21B, 21C, 21D) having an anode end connected to the first voltage source (VA, VB, VC, VD) and a cathode end, a first resistor (22A, 22B, 22C, 22D) having one end connected to the cathode end of the at least one junction diode (21A, 21B, 21C, 21D) and another end connected to ground, and a rectifying diode (23A, 23B, 23C, 23D) having an anode connected to a junction point between the cathode end of the at least one junction diode (21A, 21B, 21C, 21D) and the one end of the first resistor (22A, 22B, 22C, 22D) and a cathode connected to the common connection point. The driving circuit further includes a second resistor (26) having one end connected to ground and another end connected to the common connection point.

In an example shown in FIG. 7, the temperature sensor includes a first voltage source (VA, VB, VC, VD), at least one junction diode (21A, 21B, 21C, 21D) having an anode end connected to the first voltage source (VA, VB, VC, VD) and a cathode end, a first resistor (22A, 22B, 22C, 22D) having one end connected to the cathode end of the at least one junction diode (21A, 21B, 21C, 21D) and another end connected to ground, a rectifying diode (23A, 23B, 23C, 23D) having a cathode and an anode connected to a junction point between the cathode end of the at least one junction diode (21A, 21B, 21C, 21D) and the one end of the first resistor (22A, 22B, 22C, 22D), and a second resistor (31A, 31B, 31C, 31D) having one end connected to ground and another end connected to both the cathode of the rectifying diode (23A, 23B, 23C, 23D) and the common connection point.

In the above examples, the at least one junction diode is preferably a diode train consisting of a plurality of junction diodes connected in series. The controller is connected to the plurality of driving units and applies instruction signals thereto. Each of the plurality of driving units drives the one of the plurality of actuators in accordance with an instruction signal from the controller. When the controller determines that at least one of the plurality of driving units is in the temperature abnormality condition, the controller stops applying the instruction signals to the plurality of driving units or the controller applies the instruction signals to the plurality of driving units at a frequency lower than a predetermined frequency or applies the instruction signals intermittently to the plurality of driving units.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Various embodiments of the present invention will be described with reference to the accompanying drawings.

Figure 1:
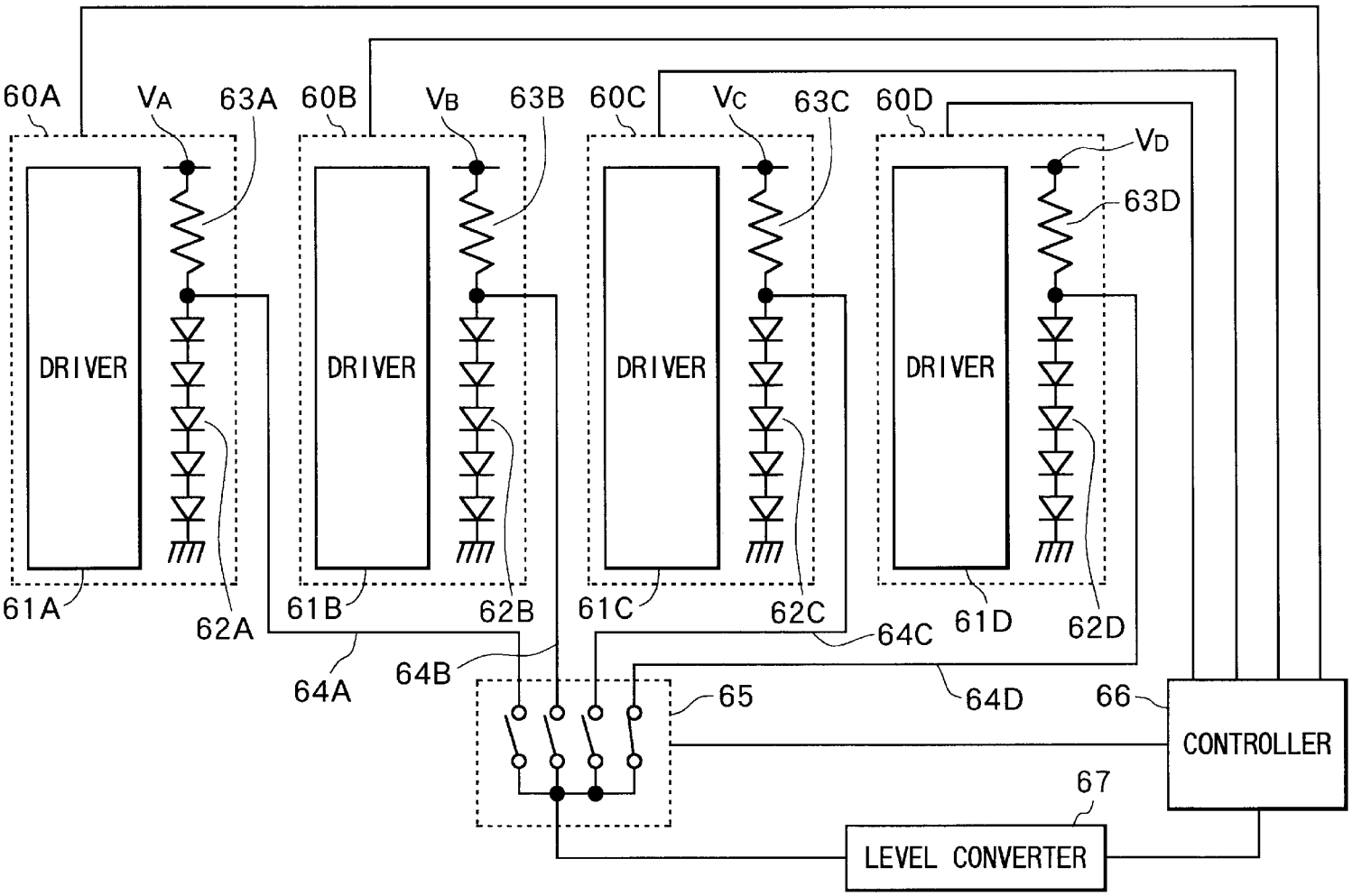
FIG. 1 PRIOR ART
FIG. 1 is a block diagram showing a conventional arrangement of an actuator driving circuit.
Figure 2:
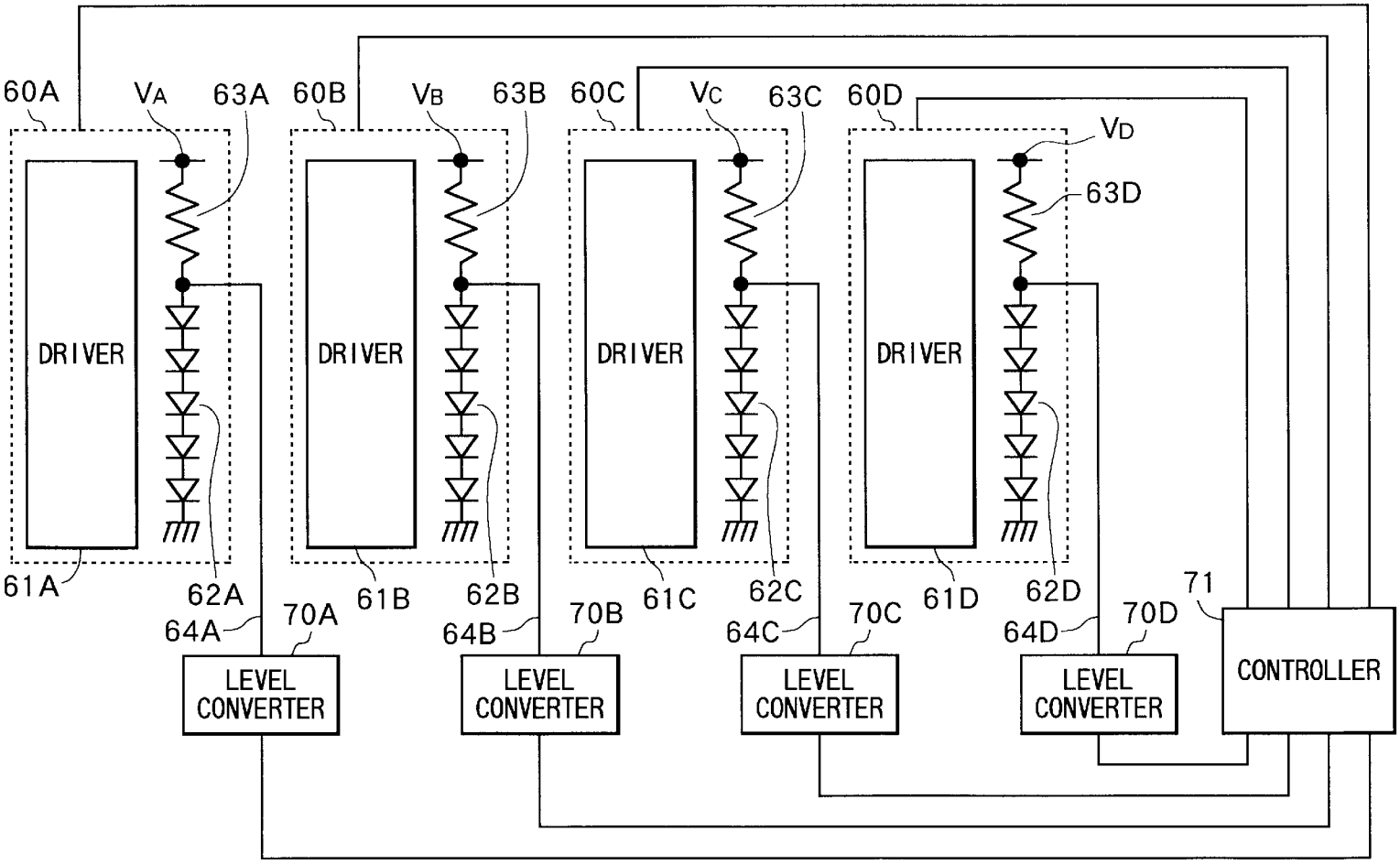
FIG. 2 PRIOR ART
FIG. 2 is a block diagram showing another conventional arrangement of an actuator driving circuit.
Figure 3:
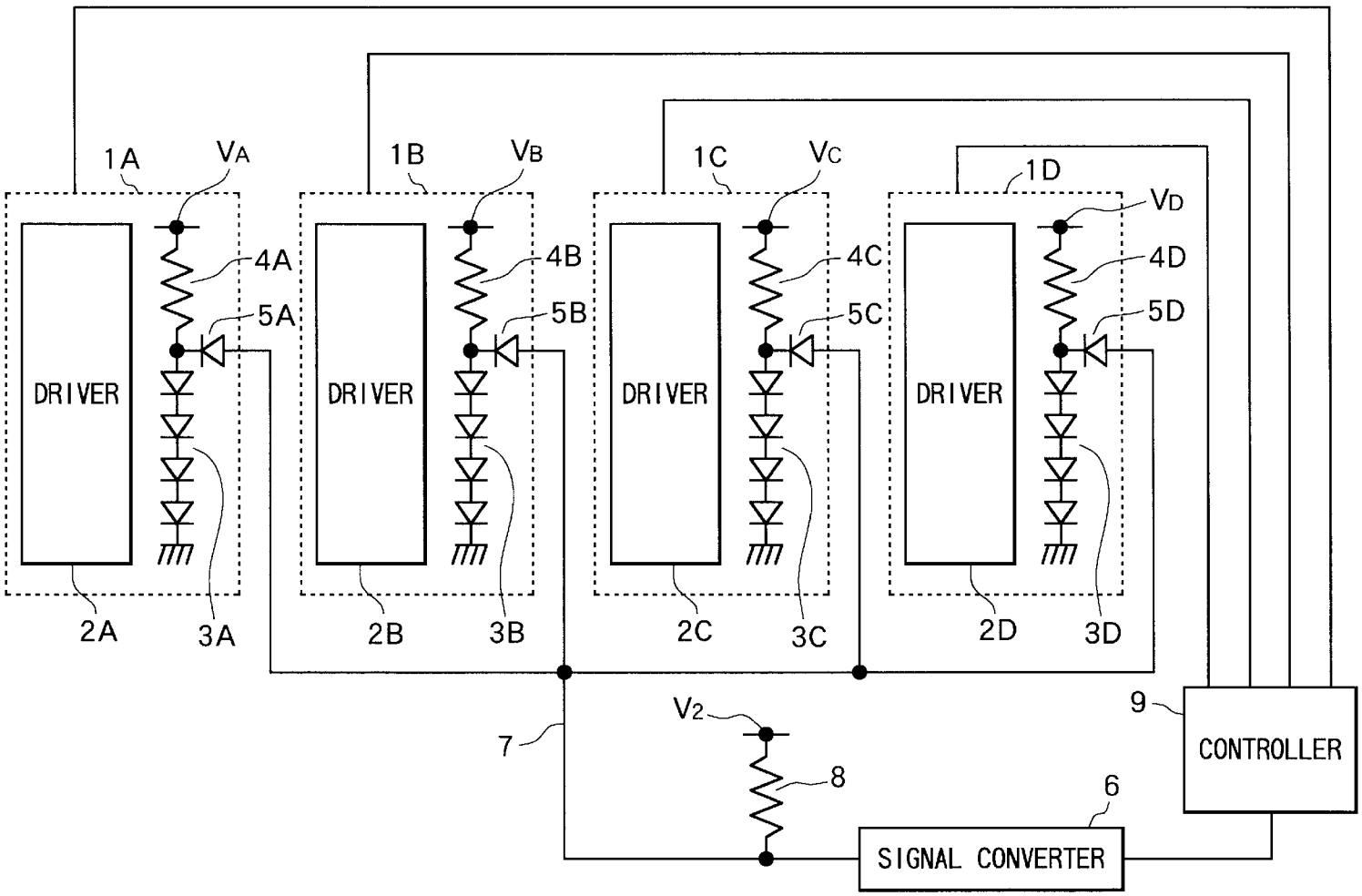
FIG. 3 is a block diagram showing an arrangement of an actuator driving circuit according to a first embodiment of the present invention.
Figure 4:
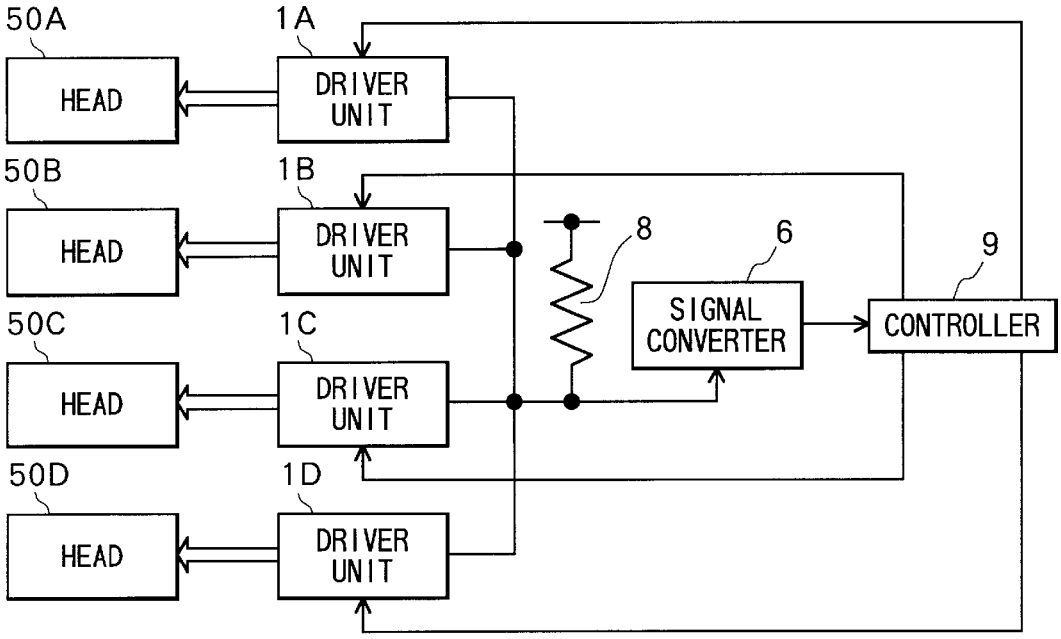
FIG. 4 is a block diagram showing an arrangement of a printing device using the driving circuit of the first embodiment.

FIG. 3 shows an actuator driving circuit according to a first embodiment of the present invention, and FIG. 4 is a block diagram showing an application of the driving circuit of the first embodiment to an ink jet printer. As shown in FIG. 3, the driving circuit is configured by first to fourth driving units 1A, 1B, 1C and 1D, a signal converter 6, a resistor 8, and a controller 9.

Driving unit 1A includes a driver 2A for driving an actuator (not shown) to be connected thereto, a temperature sensor 3A, a resistor 4A, and a diode 5A serving as a rectifier. Temperature sensor 3A is configured by a diode train consisting of a plurality of junction diodes connected in series. Cathode end of the diode train is connected to ground, and anode end thereof is connected to one terminal of resistor 4A and also to the cathode of diode 5A. The other terminal of resistor 4A is connected to a first power supply VA. The anode of diode 5A is connected through a temperature signal line 7 to signal converter 6 which in turn is connected to controller 9. The anodes of diodes 5A, 5B, 5C and 5D in respective driving units 1A, B, 1C and 1D are commonly connected at a common juncture point. The common juncture point is connected through the temperature signal line 7 to the signal converter 6 and also to one terminal of resistor 8. The other terminal of resistor 8 is connected to a second power supply V2.

Each junction diode making up of the temperature sensor 3A has a PN junction wherein the voltage developed across the PN junction changes as ambient temperature changes. More specifically, a forward voltage drop across the cathode and anode of the diode changes by about −2 mV/° C. per one PN junction. In the embodiment shown in FIG. 3, because in the driving unit 1A, five diodes including diode 5A are connected in series between the power supply V2 and ground, a temperature signal on the temperature signal line 7 has a voltage level changing with a temperature coefficient of about −10 mV/° C. Signal converter 6 receives the temperature signal and converts it to a signal of an appropriate form adapted to controller 9.

Driving units 1B, 1C and 1D have circuit configurations identical to driving unit 1A, so duplicate description is omitted herein. Corresponding parts or elements in driving units 1B, 1C and 1D to those in driving unit 1A are denoted by the combination of the same numerals and corresponding alphabetical letters.

In operation, controller 9 selectively outputs instructions to driving units 1A through 1D to drive the actuators connected thereto. Heat may be generated from the driving units 1A through 1D caused by power loss. Controller 9 monitors temperature abnormality in driving units 1A through 1D based on the temperature signal fed through signal converter 6 and determines whether all of driving units 1A through 1D are free from temperature abnormality. If controller 9 determines that all of driving units 1A through 1D are free from temperature abnormality, the monitoring of driving units 1A through 1D are repeatedly performed. If controller 9 determines that at least one of driving units 1A through 1D is in a condition of temperature abnormality, then controller 9 outputs one of three types of driving signals to each of driving units 1A through 1D to cause each driving unit to drive the associated actuator either in a slow mode or in an intermittent mode, or to halt driving the associated actuator. As a result, regardless of which driving unit the temperature abnormality is occurring, the power loss yielded in any of drivers 2A through 2D can be reduced or completely eliminated, and thus thermal destruction of driving units 1A through 1D can be prevented.

In the first embodiment, the common juncture point of the output lines from the respective driver units 1A, 1B, 1C and 1D serves as a minimum value circuit which outputs a minimum voltage signal among others to signal converter 6.

As described, according to the first embodiment of the invention, controller 9 can detect temperature abnormality of driving units 1A through 1B by merely monitoring the temperature signal on a single temperature signal line 7. Therefore, temperature monitoring interval for a plurality of driving units can be shortened in comparison with the conventional circuit configuration, and further the circuit arrangement is simplified and less costly, yet improves reliability of the circuit operation.

FIG. 4 shows application of the driving circuit of the first embodiment to a color ink jet printer having four heads 50A, 50B, 50C and 50D for ejecting cyan, magenta, yellow and black ink, respectively. The heads 50A, 50B, 50C and 50D are supplied with respective color ink from associated ink supply channels (not shown) and eject from nozzles ink droplets in response to drive signals applied by the driving units 1A, 1B, 1C and 1D, respectively. A piezoelectric element or heat generating element is used in the head to eject ink droplets.

Although not shown in FIG. 4, a print data generating device is connected to controller 9. Print data generating device generates print data to be applied to controller 9 which in turn outputs print signals to drive units 1A, 1B, 1C and 1D based on the print data. Upon receipt of the print signals from the controller 9, drive units 1A, 1B, 1C and 1D output drive signals to the corresponding heads 50A, 50B, 50C and 50D. When ink ejection frequency in each of heads 50A, 50B, 50C and 50D is relatively low, power loss is also small and an amount of heat dissipated by driving units 1A, 1B, 1C and 1D is small. Therefore, temperature rise in the driving units 1A, 1B, 1C and 1D is negligibly low. In such a normal condition, the voltage level of the temperature signal outputted from each driver unit does not decrease greatly. As a result, controller 9 determines that the temperature in any of driver units 1A, 1B, 1C and 1D has not reached a threshold level which is a criterion for determining the temperature abnormality, and therefore ink ejection is continuously performed at a regular interval.

However, when at least one of heads 50A, 50B, 50C and 50D undergoes high frequency ink ejections, power loss of the corresponding driver unit tends to become large. As a result, a large amount of heat is generated from that driver unit and temperature in the driver unit increases. This will lead level down of the temperature signal. If the temperature signal falls below a predetermined level, then controller 9 determines that any of the driver units 1A, 1B, 1C and 1D have reached an abnormally high temperature. Upon detection of the temperature abnormality condition in the driver units, controller 9 controls the driving units 1A, 1B, 1C and 1D so as to lower ink ejection frequency by, for example, extending non-print duration.

As described above, with the driving circuit of the invention, detection of temperature abnormality in any of driving units 1A, 1B, 1C and 1D can be accomplished by monitoring a temperature signal on a single temperature signal line. Because monitoring is performed at all times, detection of temperature abnormality can be carried out without delay.

Figure 5:
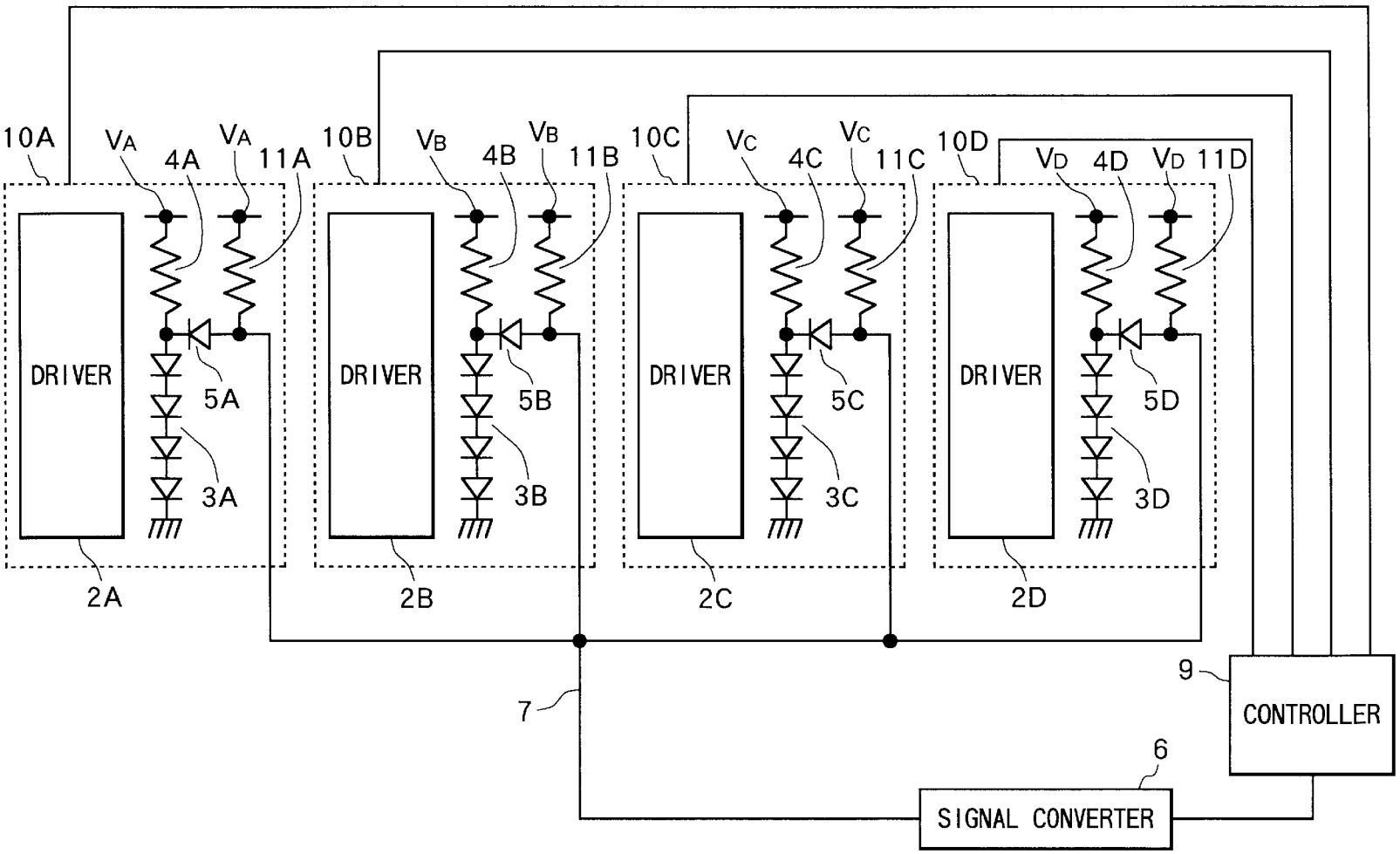
FIG. 5 is a block diagram showing an arrangement of an actuator driving circuit according to a second embodiment of the present invention.

A second embodiment of the present invention will be described with reference to FIG. 5.

The second embodiment is similar to the first embodiment but differs therefrom in that resistors 11A, 11B, 11C and 11D are provided in the second embodiment in lieu of resistor 8 provided in the first embodiment. Resistors 11A, 11B, 11C and 11D are connected between the anodes of diodes 5A, 5B, 5C and 5D and power supplies VA, VB, VC and VD, respectively. Among temperature signals derived from the driving units 10A, 10B, 10C and 10D, the temperature signal of a minimum voltage value is outputted from the common juncture point and is applied to controller 9 through signal converter 6. Like the first embodiment, the second embodiment can detect temperature abnormality in any of driving units 10A, 10B, 10C and 10D based on the temperature signal on a single temperature signal line 7.

Figure 6:
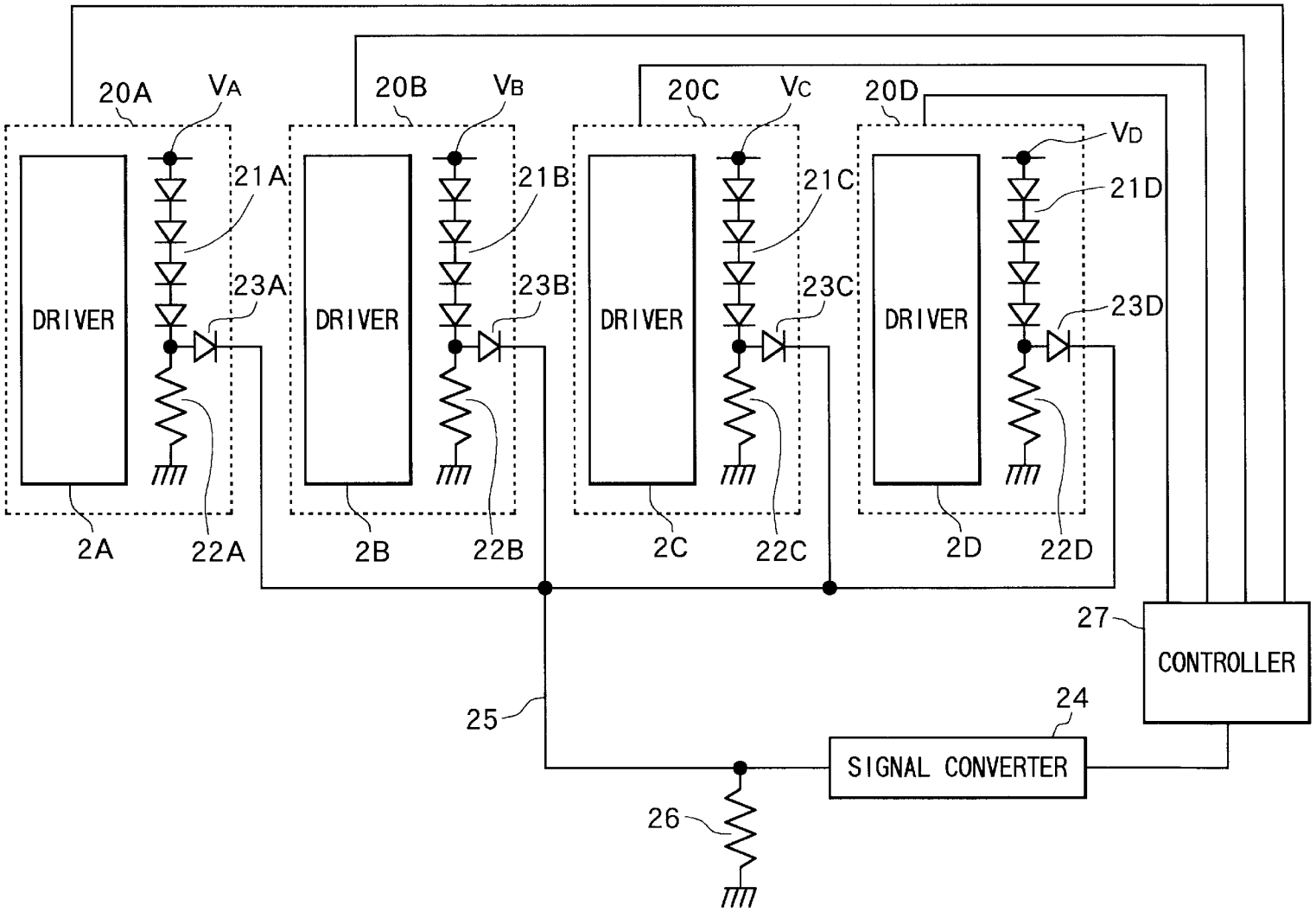
FIG. 6 is a block diagram showing an arrangement of an actuator driving circuit according to a third embodiment of the present invention.

A third embodiment of the present invention will be described with reference to FIG. 6.

The third embodiment differs from the first embodiment in the arrangement of temperature sensor in each of driving units and also in the connection of a resistor 26 which corresponds to resistor 8 in the first embodiment. More specifically, a temperature sensor 21A in a driving unit 20A is configured by a plurality of junction diodes connected in series and a resistor 22A. Cathode end of the serial connection of the diodes is connected to one end of resistor 22A, and anode end thereof is connected to a power supply VA. The other end of resistor 22A is connected to ground. A juncture point between the diode train and resistor 22A is connected to the anode of a rectifying diode 23A. The cathode of diode 23A and cathodes of corresponding diodes in other driving units 20B, 20C and 20D are connected together. The common juncture point of the cathodes of diodes 23A, 23B, 23C and 23D in driving units 20A, 20B, 20C and 20D serves as a minimum value circuit and outputs a minimum value voltage signal among others. The common junction point is connected to one end of resistor 26, and the other end thereof is grounded. The voltage developed across resistor 26 is indicative of the highest temperature in any one of the driving units and is applied through a signal converter 24 to a controller 27.

In the third embodiment, the temperature signals derived from the respective driving units are applied to the common junction point and the temperature signal on a temperature signal line 25 is applied to controller 27 through signal converter 24. When any of the driving units are in conditions of abnormal temperature, the voltage level of the temperature signal applied to the signal converter 24 is higher than that of the temperature signal when there is no temperature abnormality in any of the driving units. The same advantage as obtained in the first embodiment can also be obtained in the third embodiment.

Figure 7:
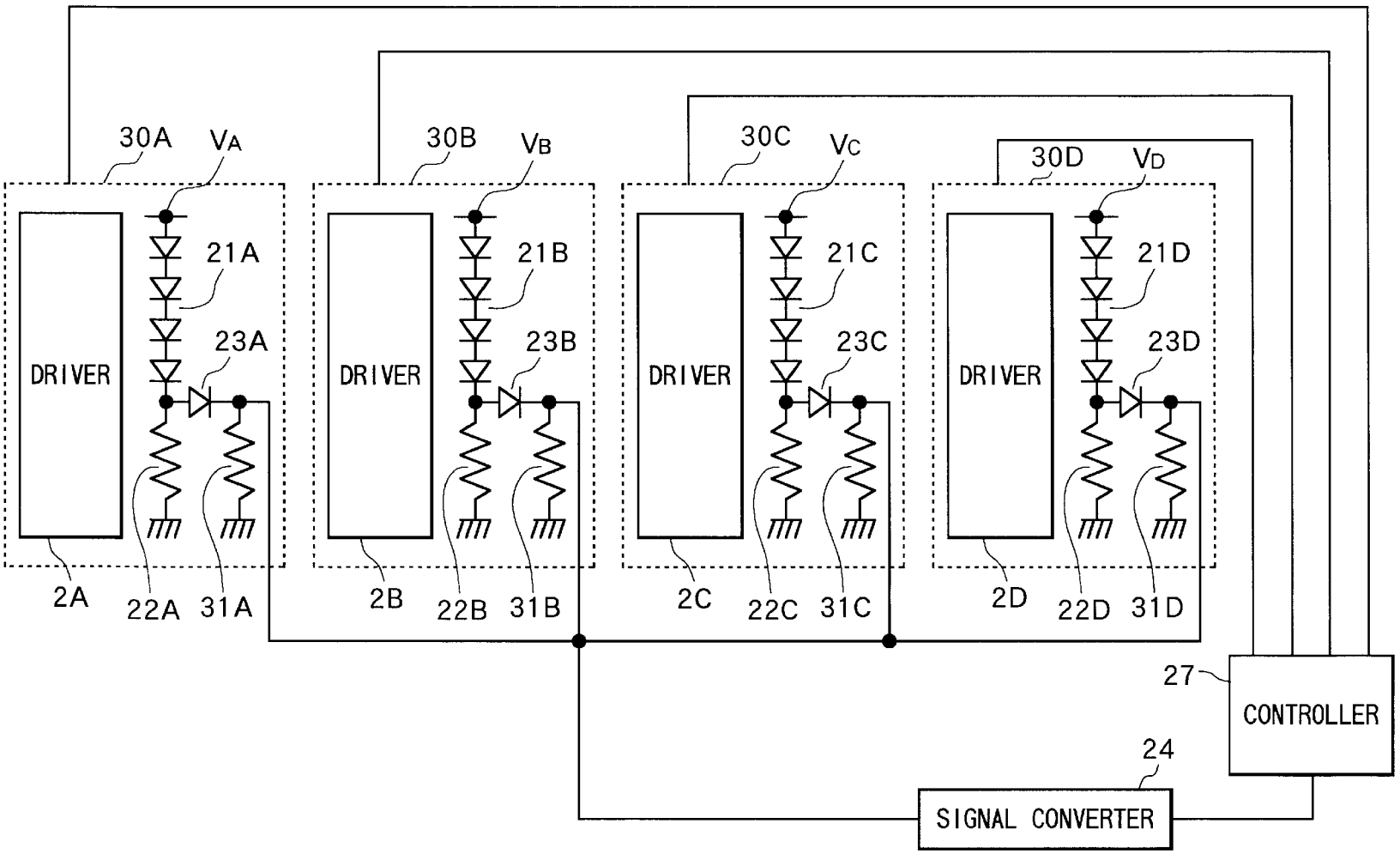
FIG. 7 is a block diagram showing an arrangement of an actuator driving circuit according to a fourth embodiment of the present invention.

A fourth embodiment of the present invention will be described with reference to FIG. 7. The fourth embodiment is similar to the third embodiment but differs therefrom in that resistors 31A, 31B, 31C and 31D are respectively connected between the cathodes of rectifying diodes 22A, 22B, 22C and 22D and ground. By the provision of individual resistors 31A, 31B, 31C and 31D to temperature sensors 21A, 21B, 21C and 21D, resistor 26 provided in the third embodiment is removed. The voltages developed across resistors 31A, 31B, 31C and 31D are indicative of temperature signals in driving units 30A, 30B, 30C and 30D, and those temperature signals are applied to a common junction point.

As described above, the present invention is particularly useful when applied to devices having a plurality of driving units in which drivings of all the driving units need to be halted when at least one of the driving unit has become unduly high temperature.

While various exemplary embodiments of this invention have been described in detail, those skilled in the art will recognize that there are many possible modifications and variations which may be made in these exemplary embodiments while yet retaining many of the novel features and advantages of the invention. Accordingly, all such modifications and variations are intended to be included within the scope of the appended claims.

Although a printer head is illustrated and described as an example of the actuator, the driver circuit of the present invention is applicable to any kind of actuators which convert electrical energy to mechanical energy. Example of actuators includes a motor for a printer.

Although in the embodiments described above, no determination is made as to which driver unit is in a temperature abnormality condition, the driver circuits may be modified to have a capability of identifying the driver unit of temperature malfunction. To this end, the controller may be modified to execute an identification process for identifying which driving unit is involved with a temperature malfunction. More specifically, the controller disables the first driving unit but enables the remaining three driving units, that is, the controller does not send an enabling (instruction) signal to the first driving unit but sends enabling signals to the second to fourth driving units after detection of the temperature malfunction in any of the driving units. The controller then determines whether or not the first driving unit is involved with a malfunction based on the temperature signal. Similarly, whether or not the second driving unit is involved with a malfunction is determined by disabling the second driving units and enabling the first, third and fourth driving units. The same processing is performed with respect to the third and fourth driving units. In this manner, the driving units with temperature malfunction can be identified.

Further, the second to fourth embodiments of the invention can also be applied to a color ink jet printer of the type described in FIG. 4.

What is claimed is:

1. A driving circuit for selectively driving a plurality of actuators, comprising:

a plurality of driving units, each including a driver connected to one of the plurality of actuators, a temperature sensor sensing a temperature of said driver, and an output line outputting a temperature signal indicative of the temperature of said driver, wherein output lines of said plurality of driving units are commonly connected to form a common connection point, the common connection point outputting a combined temperature signal indicative of the temperature of said plurality of driving units, and a controller having an input connected to said common connection point to receive the combined temperature signal, said controller determining whether or not at least one of said plurality of driving units is in a temperature abnormality condition based on the combined temperature signal.

2. A driving circuit according to claim 1, wherein said temperature sensor includes a first current supplying source, at least one junction diode having a cathode end connected to ground and an anode end connected to said first current supplying source, and a rectifying diode having an anode connected to said common connection point and a cathode connected to a juncture point between said first current supplying source and the anode end of said at least one junction diode, and further comprising a second current supplying source connected to said common connection point.

3. A driving circuit according to claim 2, wherein said second current supplying source includes a voltage source and a resistor having one end connected to said voltage source and another end connected to said common connection point.

4. A driving circuit according to claim 3, wherein said at least one junction diode is a diode train consisting of a plurality of junction diodes connected in series.

5. A driving circuit according to claim 4, wherein said controller is connected to said plurality of driving units and applies instruction signals thereto, each of said plurality of driving units driving the one of the plurality of actuators in accordance with an instruction signal from said controller, and wherein said controller stops applying the instruction signals to said plurality of driving units when said controller determines that at least one of said plurality of driving units is in the temperature abnormality condition.

6. A driving circuit according to claim 4, wherein said controller is connected to said plurality of driving units and applies instruction signals thereto at a predetermined frequency, each of said plurality of driving units driving the one of the plurality of actuators in accordance with an instruction signal from said controller, and wherein said controller applies the instruction signals to said plurality of driving units at a frequency lower than the predetermined frequency when said controller determines that at least one of said plurality of driving units is in the temperature abnormality condition.

7. A driving circuit according to claim 4, wherein said controller is connected to said plurality of driving units and continuously applies instruction signals thereto, each of said plurality of driving units driving the one of the plurality of actuators in accordance with an instruction signal from said controller, and wherein said controller applies the instruction signals intermittently to said plurality of driving units when said controller determines that at least one of said plurality of driving units is in the temperature abnormality condition.

8. A driving circuit according to claim 1, wherein said temperature sensor includes a first current supplying source, at least one junction diode having a cathode end connected to ground and an anode end connected to said first current supplying source, a second current supplying source, and a rectifying diode having an anode connected to both said second current supplying source and said common connection point and a cathode connected to a junction point between said first current supplying source and the anode end of said at least one junction diode.

9. A driving circuit according to claim 8, wherein said at least one junction diode is a diode train consisting of a plurality of junction diodes connected in series.

10. A driving circuit according to claim 1, wherein said temperature sensor includes a first voltage source, at least one junction diode having an anode end connected to said first voltage source and a cathode end, a first resistor having one end connected to the cathode end of said at least one junction diode and another end connected to ground, and a rectifying diode having an anode connected to a junction point between the cathode end of said at least one junction diode and the one end of said first resistor and a cathode connected to the common connection point, and further comprising a second resistor having one end connected to ground and another end connected to said common connection point.

11. A driving circuit according to claim 10, wherein at least one junction diode is a diode train consisting of a plurality of junction diodes.

12. A driving circuit according to claim 1, wherein said temperature sensor includes a first voltage source, at least one junction diode having an anode end connected to said first voltage source and a cathode end, a first resistor having one end connected to the cathode end of said at least one junction diode and another end connected to ground, a rectifying diode having a cathode and an anode connected to a junction point between the cathode end of said at least one junction diode and the one end of said first resistor, and a second resistor having one end connected to ground and another end connected to both the cathode of said rectifying diode and said common connection point.

13. A driving circuit according to claim 12, wherein at least one junction diode is a diode train consisting of a plurality of junction diodes.

14. A driving circuit according to claim 1, wherein said controller is connected to said plurality of driving units and applies instruction signals thereto, each of said plurality of driving units driving the one of the plurality of actuators in accordance with an instruction signal from said controller, and wherein when said controller determines that at least one of said plurality of driving units is in the temperature abnormality condition, said controller identifies a driving unit that is in the temperature abnormality condition based on the combined temperature signal obtained when the driving unit thus identified is disabled by said controller.

* * * * *